US006016722A

United States Patent [19]

Gierer et al.

[11] Patent Number: 6,016,722

[45] Date of Patent: Jan. 25, 2000

[54] SHOCK-ABSORBING CLAW HAMMER

[75] Inventors: Joseph T. Gierer, Glen Carbon, Ill.; David L. Pringle, Town and Country, Mo.

[73] Assignee: Emerson Electric Co., St. Louis, Mo.

[21] Appl. No.: 09/005,199

[22] Filed: Jan. 9, 1998

Related U.S. Application Data

[60] Provisional application No. 60/053,305, Jul. 21, 1997.

[51] Int. Cl.[7] ..... B25D 1/00

[52] U.S. Cl. ..... 81/22; 81/20; 81/25

[58] Field of Search ..... 81/20, 22, 25

[56] References Cited

U.S. PATENT DOCUMENTS

| | | | |
|---|---|---|---|
| 1,045,145 | 11/1912 | Hubbard | 81/22 |
| 1,501,095 | 7/1924 | Brock | 81/25 |
| 2,451,217 | 10/1948 | Heinrich | 81/22 |
| 2,737,216 | 3/1956 | Kenerson . | |
| 2,776,689 | 1/1957 | Falzone | 145/29 |
| 2,833,323 | 5/1958 | Strickland | 145/29 |
| 3,000,414 | 9/1961 | Cordis | 81/22 |
| 4,039,012 | 8/1977 | Cook . | |
| 4,183,385 | 1/1980 | Burkybile | 145/29 A |
| 4,216,808 | 8/1980 | Royce . | |
| 4,331,193 | 5/1982 | Tudisco . | |
| 4,373,565 | 2/1983 | Soto . | |
| 4,498,464 | 2/1985 | Morgan . | |
| 4,738,166 | 4/1988 | Yamaguchi . | |
| 4,831,901 | 5/1989 | Kinne | 81/20 |
| 5,216,939 | 6/1993 | Swenson . | |
| 5,249,776 | 10/1993 | Johnson . | |
| 5,289,742 | 3/1994 | Vaughan . | |
| 5,375,487 | 12/1994 | Zimmerman . | |
| 5,408,902 | 4/1995 | Burnett . | |
| 5,537,896 | 7/1996 | Halder . | |

*Primary Examiner*—David A. Scherbel
*Assistant Examiner*—Dung Van Nguyen
*Attorney, Agent, or Firm*—Arnold White & Durkee; Mark L. Gleason

[57] ABSTRACT

A shock-absorbing claw hammer includes a handle, a claw and a striking head. Vibrations and shock in the handle and head, as well as recoil, caused by the striking head striking an object are at least partially reduced by shock-absorbing means.

24 Claims, 4 Drawing Sheets

SHOCK-ABSORBING CLAW HAMMER

CROSS-REFERENCE TO RELATED APPLICATION

This application claims the benefit of U.S. Provisional Application No. 60/053,305, entitled "Dead Blow Claw Hammer," filed Jul. 21, 1997 by the same inventor, which is incorporated herein by reference in its entirety.

BACKGROUND OF THE INVENTION

1. FIELD OF THE INVENTION

This invention relates to hammers for driving nails and striking various objects and, in particular, shock-absorbing or dead blow hammers that reduce the recoil and vibration caused by the hammer strike. More particularly, the present invention relates to a shock-absorbing hammer including a claw feature.

2. DESCRIPTION OF RELATED ART

When a percussive tool, such as a hammer, strikes the surface of an object, part of the energy produced by the strike is used to perform desired work (e.g., drive a nail), part is converted into heat, and part is dissipated through the hammer. The energy that is dissipated through the hammer often produces undesirable results such as recoil of the hammer from the struck surface or excessive vibration of the hammer. The undesirable results produced by hammer strikes have been a persistent problem for the makers of hammers and other percussive tools.

Many users of hammers prefer the vibration-reducing feel of wood handled hammers, rather than integral steel handle/head hammers. A common perception is that fatigue is reduced at the end of the day when using a hammer having a wood handle verses a steel handle. However, wooden handled hammers will invariably break, typically at the wedged joint between the handle and steel head due to the prying action of nail pulling. To overcome this shortcoming, many manufacturers make integral steel handle/head hammers which hold up extremely well to nail pulling, but the shock absorbing feature of the wood handle is lost. These problems are discussed in an article entitled "Nailing Basics," by Larry Haun in *Fine Homebuilding*, Jul. 1997 at page 80.

In the past, various attempts have been made to reduce undesirable results produced by a hammer strike. Hammers that have minimal rebound or recoil characteristics are sometimes referred to as "dead blow" hammers. One of the earliest attempts reflected in the prior art to produce a dead-blow hammer is U.S. Pat. No. 1,045,145, issued in November 1912 to E.O. Hubbard ("Hubbard"). As explained by Hubbard, when the Hubbard hammer is struck against a surface, the striking head will be forced against a cushion, such that the cushion absorbs a portion of the shock of impact produced by the strike.

Following Hubbard, several other attempts were made to reduce the undesirable results of a hammer strike and, in particular, to reduce the recoil or rebound produced when a hammer strike occurs. Several early approaches for reducing recoil in hammers are summarized in U.S. Pat. No. 2,604,914 to Kahlen ("Kahlen") issued in July 1952. In particular, Kahlen indicates that, by 1952, known methods for reducing hammer recoil included placing either a slug, a charge of round shot, or a charge of powdered material in a chamber immediately behind a striking face of the hammer, such that the object(s) placed behind the striking head will absorb some of the forces produced by the hammer strike. The particular approach disclosed in Kahlen involved the placement of a charge of irregularly-shaped, hard heavy particles in a chamber immediately behind the striking head of a hammer.

In addition to solutions involving cushions and charge loads, several solutions utilizing resilient members, such as elastic inserts and springs, were proposed to address the hammer strike problems, whereby a portion of the energy developed from the hammer strike is dissipated through the resilient member. Other designs, such as that disclosed in U.S. Pat. No. 5,408,902, use a "lagging mass," which is positioned to move towards the striking portion of the hammer head when it impacts, thus impacting the striking portion to reduce hammer recoil.

Theses early approaches suffer from one or more difficulties. For example, the use of slidable weights or slugs behind the striking head of the hammer is problematic because the weights themselves develop potential energy when the hammer strikes a surface and tend to recoil, thus, causing undesirable vibration or oscillation of the hammer. Further, shot-filled hammers are limited: (i) because the requirement for a hollow chamber renders the size of such hammers out of proportion to their weight; and (ii) because, unless a special shot mixture is utilized, the shot is often not useful in preventing hammer recoil. Moreover, in prior art dead blow hammers, the prying and nail pulling capability of common claw hammers has been forfeited in the attempts to reduce vibration and recoil.

Further discussion of the prior art and its associated shortcomings is provided in U.S. Pat. No. 1,045,145; U.S. Pat. No. 2,604,914; U.S. Pat. No. 2,928,444; U.S. Pat. No. 4,831,901; U.S. Pat. No. 5,118,117; U.S. Pat. No. 5,408,902; and German Patent No. 1,273,449.

Thus, a need exists for a shock-absorbing hammer which includes a claw feature for pulling nails and prying, and that addresses other problems associated with prior art shock-absorbing or dead blow hammers.

SUMMARY OF THE INVENTION

In one aspect of the invention, a shock-absorbing claw hammer includes a head which has a striking head portion with a lower surface, a claw portion extending generally opposite the striking head portion, and a handle extending generally perpendicular to the striking head portion and the claw portion. The head defines an opening therein, and a slit extends from the opening to the lower surface. In a further aspect, the opening is filled with an elastic plug. In a still further aspect, the slit is shaped so as to form interlocking puzzle pieces for preventing the slit from completely opening.

In another aspect of the invention, a shock-absorbing claw hammer includes a handle, a striking head including a striking surface and an insert member extending from the string head opposite the striking surface. A claw is attached to the handle, and the handle defines a cavity having an axis generally transverse to the handle. The cavity is adapted to slidably receive the insert. The handle defines a first bore therein and the insert defines a second bore having a diameter larger than the diameter of the first bore. A retaining member is positioned within the first and second bores to retain the insert within the cavity and allow the striking head to slide relative to the handle.

BRIEF DESCRIPTION OF THE DRAWINGS

Other objects and advantages of the invention will become apparent upon reading the following detailed description and upon reference to the drawings in which.

Figure 1:
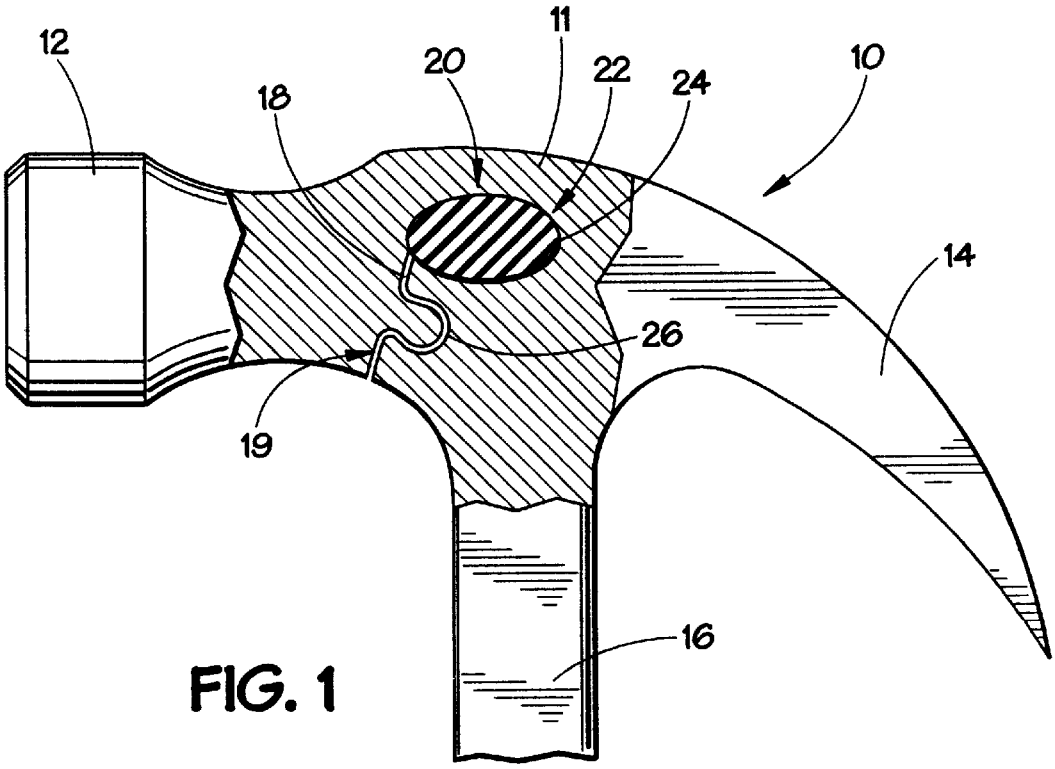
FIG. 1 is an elevation view of an exemplary embodiment of a split-head claw hammer having an interlocking slit.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Figure 2:
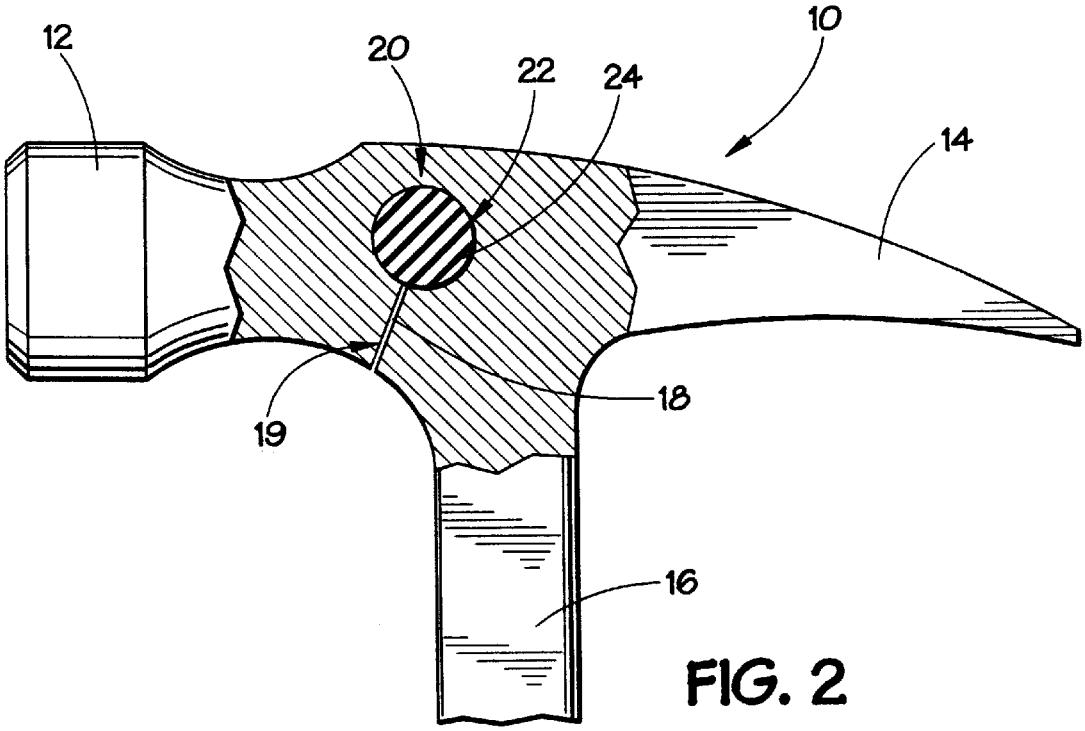
FIG. 2 is an elevation view of an alternate embodiment of a split-head claw hammer having a straight slit.

Turning to the drawings and in particular, FIG. 1 and FIG. 2, a split-head embodiment of a shock-absorbing claw hammer in accordance with the present invention is illustrated. The split-head claw hammer 10 includes a head 11 which has a striking portion 12 and a claw portion 14. The claw portion 14 defines a generally V-shaped notch (not shown) for grabbing nails during nail pulling. A handle 16 is coupled to the head 11, and may be integrally formed therewith. A slit 18 is cut in the head 11 such that roughly equal mass is in the striking portion 12 and the claw portion 14. The slit 18 is about 0.010 inch to 0.040 inch, and it may be manufactured using laser cutting, wire EDM cutting or abrasive water jet cutting. The slit 18 runs to the bottom edge of the hammer head 11 so that the striking portion 12 and the claw portion 14 make contact across the slit 18 in a contact area 19 to deliver the favorable lagging mass effect.

A hardened shim (not shown) may be placed in the slit 18 in order to control the gap spacing of the slit 18. This may be desirable for a manufacturing technique such as water jet cutting, which can efficiently and consistently create gaps of 0.040 inch, but typically, not significantly smaller. Hence, if a gap formed by the slit 18 of 0.015 inch is sought, for example, a shim that is 0.025 inch thick may be used to provide the desired gap of 0.015.

The hammer head 11 defines a hole 22 formed therein, which may be filled with an elastic plug 24, which may comprise a relatively low durometer rubber plug. The slit 18 extends from the hole 22 to the bottom of the hammer head 11. A connecting region 20 is located in the head 11 opposite the slit 18, which connects the striking portion 12 and the claw portion 14 of the head 11. In addition to connecting the striking portion 12 and the claw portion 14, the connecting region 20 acts as a flat cantilever spring, allowing the two portions of the head to contact each other in the contact area 19 upon a hammer strike. This greatly reduces hammer recoil and vibration to the hand, in turn, reducing fatigue.

The hole 22 in the head 11 has several purposes: (i) it accurately defines the amount of material in the connecting region 20, thus allowing for fine control over the stiffness of the flat cantilever spring by varying the size of the hole 22; (ii) its radius serves as a stress reliever; and (iii) the elastic plug 24 which fills the hole 22 further defines the stiffness of the flat cantilever spring and minimizes tuning fork-like vibrations that may otherwise occur upon a hammer strike.

The slit 18 runs from the hole 22 to the bottom of the hammer head 11, which allows the slit 18 to close up when the claw portion 14 is used for nail pulling, thus preventing high tensile stresses from occurring. In the embodiment illustrated in FIG. 1, the slit 18 is formed such that the striking portion 12 and the claw portion 14 of the hammer head 11 form interlocking "puzzle" pieces 26 ensuring that the slit 18 will not completely open under any circumstance. An alternate embodiment of the split head claw hammer 10 using a straight slit 18 is illustrated in FIG. 2.

Figure 3:
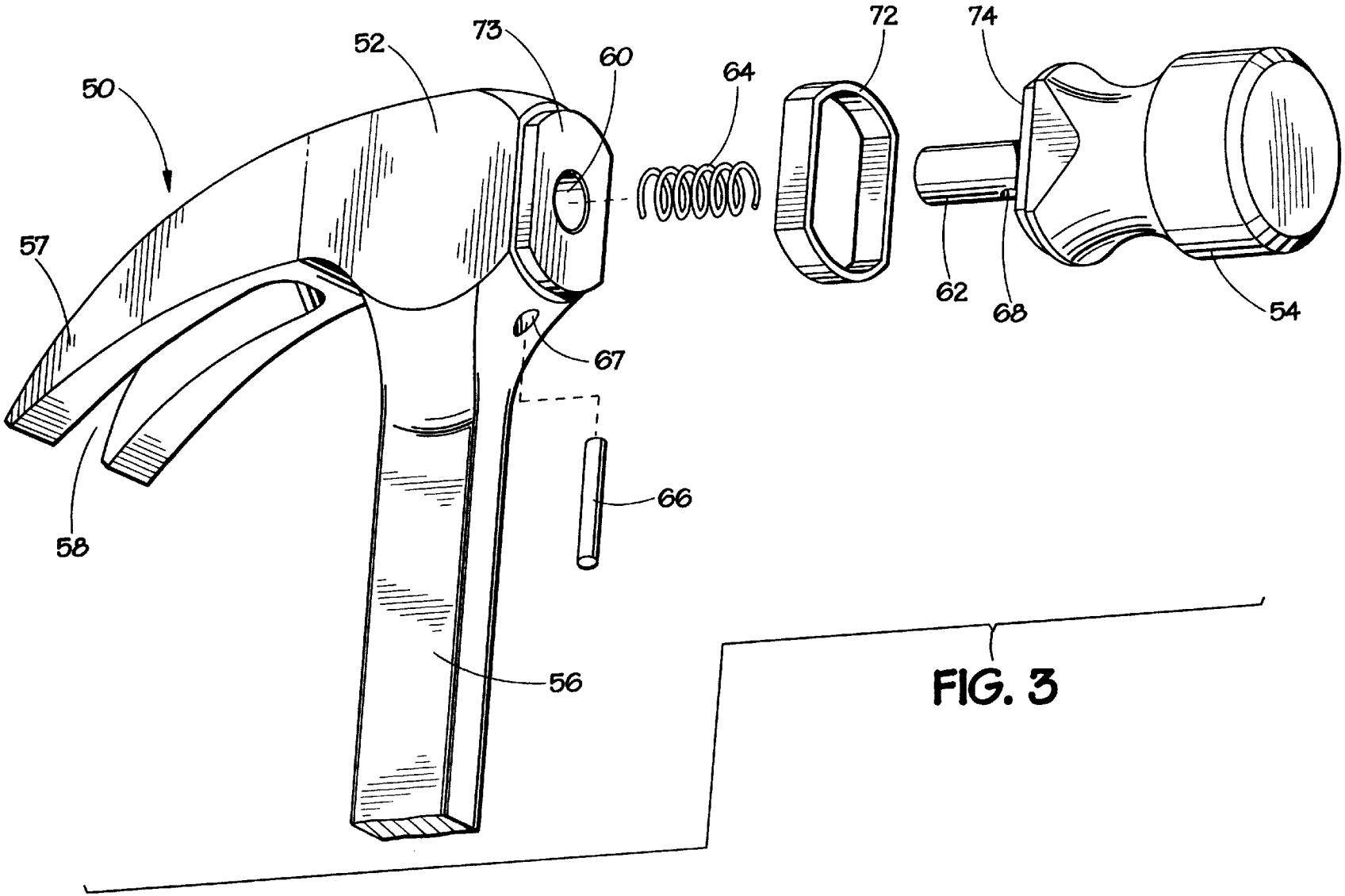
FIG. 3 is an exploded front-perspective view of an exemplary embodiment of a sliding head claw hammer in accordance with the invention.
Figure 4:
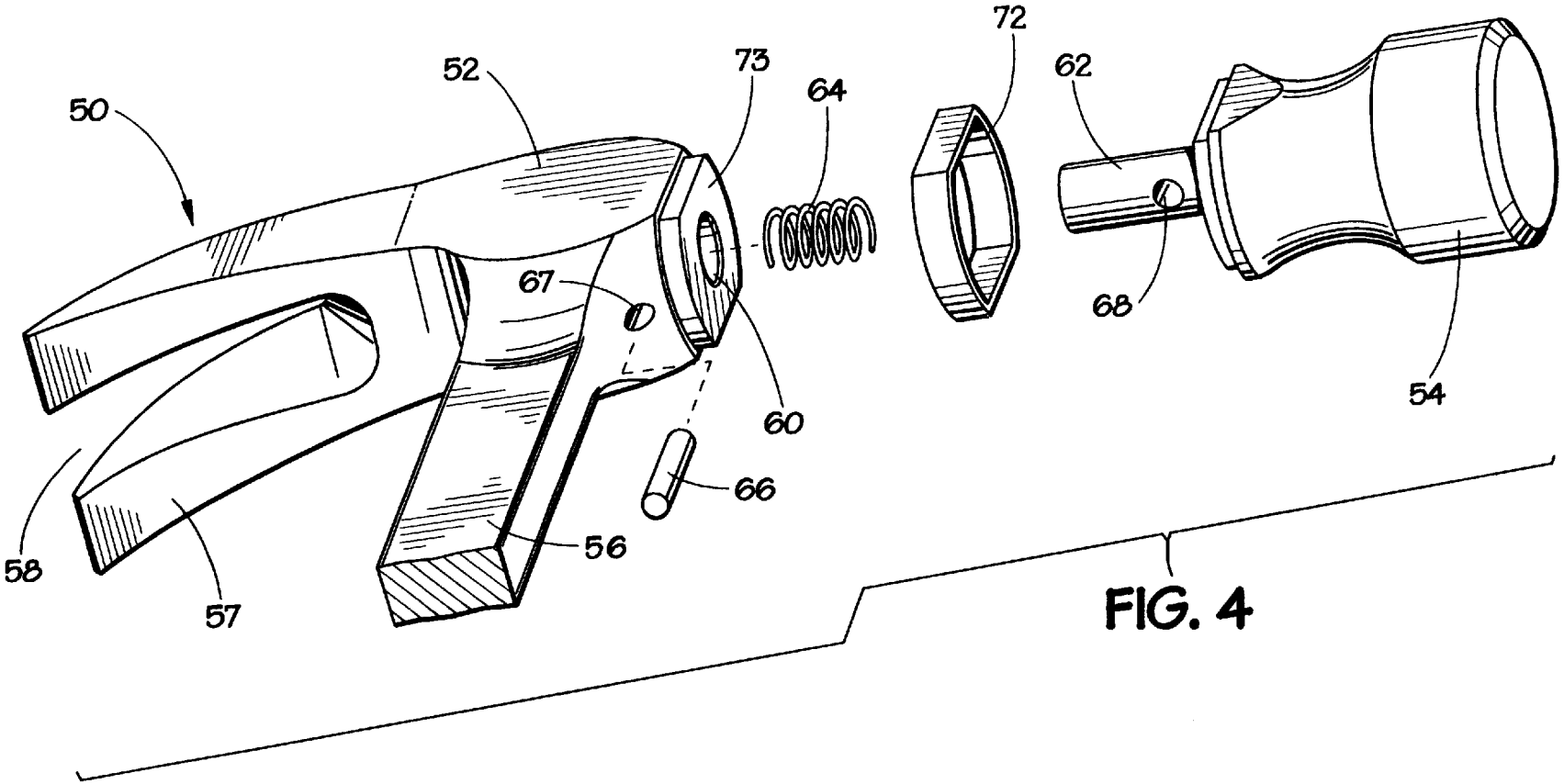
FIG. 4 is an exploded bottom-perspective view of the exemplary embodiment of FIG. 3.
Figure 5:
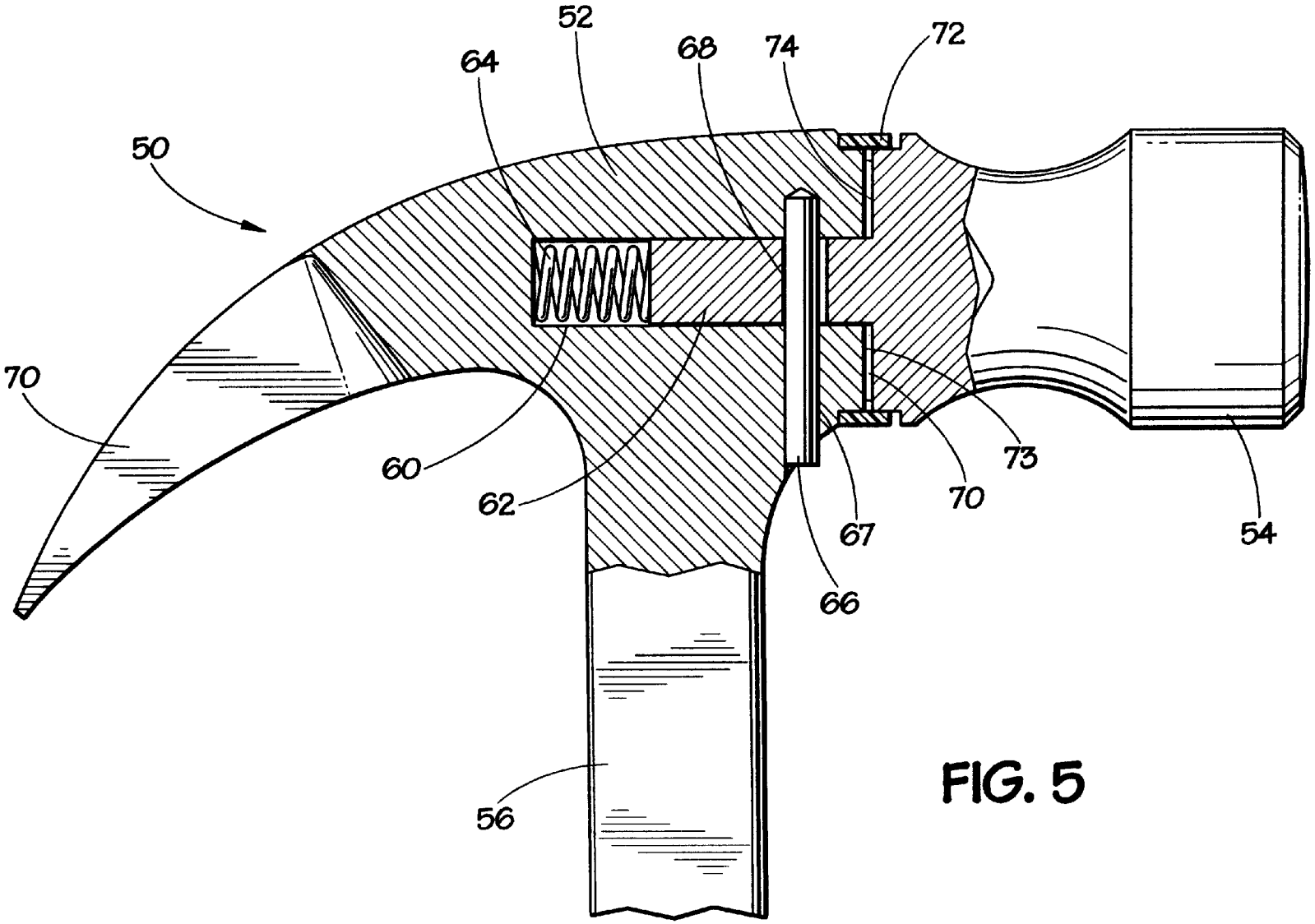
FIG. 5 is a cross sectional elevation view of the exemplary embodiment of FIG. 3.

FIG. 3, FIG. 4 and FIG. 5 illustrate a sliding head embodiment of a shock absorbing claw hammer in accordance with the present invention. The sliding head claw hammer 50 generally includes a handle/claw piece 52, and a striking head piece 54. The handle/claw piece 52 comprises a handle 56 and a claw portion 57, which may be integrally formed to ensure adequate strength for nail pulling. Alternately, the handle/claw piece 52 may be of a two-part construction, with the claw portion 57 coupled to the handle 56 by any suitable means known by one skilled in the art. The claw portion 57 includes a generally V-shaped notch 58 formed therein for grabbing nails during nail pulling.

The handle/claw piece 52 defines a cavity 60 which has an axis generally transverse to the handle and the striking head piece 54 defines an insert 62 designed to be slidably received by the cavity 60. A compressible biasing element 64 is positioned in the cavity 60 between the handle/claw piece 52 and the striking head piece 54, and a retaining member such as a pin 66 is received by a first pin receiving bore 67 formed in the handle/claw piece 52 and a second pin receiving bore 68 formed in the striking head piece 54. The pin 66 is inserted in pin receiving bores 67 and 68 to hold the hammer 50 together. The diameter of pin receiving bore 68 is larger than the diameter of the pin 66, thereby allowing the insert 62 to slide a limited distance within the cavity 60. In an embodiment of the invention, the pin 66 has a diameter of about 0.125 inch, with the diameter of pin receiving bore 68 being about 0.166 inch larger then the diameter of the pin 66.

The handle/claw piece 52 and the striking head piece 54 are sized such that, when assembled, there is a gap 70 (shown in FIG. 5) provided so that the striking head piece 54 may move relative to the handle/claw piece 52 when the insert 62 slides within the cavity 60. A shroud 72 covers the gap 70. Upon a hammer strike, the insert 62 slides within the cavity 60, allowing the handle/claw piece 52 and the striking head piece 54 to move towards each other, such that hardened secondary contact surfaces 73 and 74 contact each other, providing a vibration-dampening effect. Thus, the handle/claw piece 52 functions as the lagging mass in this embodiment.

The compressible element 64 biases the striking head piece 54 away from the handle/claw piece 52, with the pin 66 acting as the hard stop for this biasing force. The compressible element may comprise, for example, a compression spring, an elastic plug, or the like. The clearance 70 between the handle/claw piece 52 and the striking head piece 54 is about 0.010 inch to about 0.040 inch in a particular embodiment in accordance with the invention.

The above description of exemplary embodiments of the invention are made by way of example and not for purposes of limitation. Many variations may be made to the embodiments and methods disclosed herein without departing from the scope and spirit of the present invention.

What is claimed is:

1. A shock-absorbing claw hammer comprising:

a head including a striking head portion and a claw portion extending generally opposite the striking head portion, the head defining an axis;

a handle coupled to the head and extending from a lower surface of the head generally perpendicular to the head;

the head defining an opening extending therethrough, the opening defining an axis situated generally transverse to the axis of the head and a slit extending from the opening to the lower surface.

2. The shock-absorbing claw hammer of claim 1 wherein the opening is filled with an elastic plug.

3. The shock-absorbing claw hammer of claim 2 wherein the elastic plug comprises a rubber plug.

4. The shock-absorbing claw hammer of claim 1 wherein the slit has a width of about 0.010 to 0.040 inch.

5. The shock-absorbing claw hammer of claim 1 further comprising the slit being shaped such that the striking head portion and the claw portion form interlocking puzzle pieces thus preventing the slit from completely opening.

6. The shock-absorbing claw hammer of claim 1 wherein the slit defines a generally straight line extending from the opening to the lower surface.

7. The shock-absorbing claw hammer of claim 1 wherein the slit is positioned such that the slit closes when the claw portion is used for nail pulling.

8. The shock-absorbing claw hammer of claim 1 wherein the slit and the handle generally define an angle of less than 45°.

9. The shock-absorbing hammer of claim 1 wherein the opening defines a connecting region opposite the slit which connects the striking portion and the claw portion.

10. The shock-absorbing hammer of claim 9, wherein the connecting region acts as a flat cantilever spring which allows the striking portion and the claw portion to contact each other upon a hammer strike.

11. The shock-absorbing hammer of claim 10 wherein the opening is sized such that a desired stiffness of the flat cantilever spring is obtained.

12. The shock-absorbing claw hammer of claim 1 wherein the handle is integrally formed with the head.

13. A shock absorbing claw hammer comprising:

a handle;

a striking head including a primary striking surface and an insert member extending from the striking head opposite the striking surface;

a claw coupled to the handle, the handle defining a cavity therein having an axis generally transverse to the handle, the cavity being adapted to slidably receive the insert;

a retaining member;

the handle defining a first bore therein and the insert defining a second bore having a diameter larger than the diameter of the first bore; and the retaining member being positioned within the first and second bores to retain the insert within the cavity and allow the striking head to slide axially relative to the handle upon a hammer strike to reduce vibrations produced by the hammer strike.

14. The shock-absorbing claw hanger of claim 13 wherein:

the striking head includes a secondary striking surface opposite the primary striking surface; and the handle includes a secondary striking surface opposite the claw; and wherein the secondary surfaces contact each other upon a hammer strike to reduce vibration.

15. The shock-absorbing claw hammer of claim 13 further comprising a biasing element for positioning the striking head away from the handle so as to form a gap between the striking head and the handle.

16. The shock-absorbing claw hammer of claim 15 further comprising a shroud for covering the gap.

17. The shock-absorbing claw hammer of claim 13 wherein the biasing element comprises a compression spring.

18. The shock-absorbing claw hammer of claim 13 wherein the biasing element comprises an elastic plug.

19. The shock-absorbing claw hammer of claim 13 wherein the gap is about 0.010 to 0.040 inch wide.

20. The shock-absorbing hammer of claim 13 wherein the retaining member comprises a retaining pin.

21. The shock-absorbing claw hammer of claim 20 wherein the retaining pin has a diameter of about 0.125 inch.

22. The shock-absorbing claw hammer of claim 20 wherein the second bore has a diameter that is about 0.0166 inch larger than the diameter of the retaining pin.

23. The shock-absorbing hammer of claim 13 wherein the claw is integrally formed with the handle.

24. A hammer for striking objects comprising:

a handle;

a one piece head member coupled to the handle;

the head member defining a striking portion and a claw portion, wherein the construction of the head member is such that vibrations are produced in the handle when an object is struck by the striking portion; and wherein the head member further includes means for absorbing at least a portion of the vibrations.

* * * * *